US010035110B2

(12) United States Patent
Wu et al.

(10) Patent No.: US 10,035,110 B2
(45) Date of Patent: Jul. 31, 2018

(54) FINE BUBBLE GENERATING DEVICE

(71) Applicant: Chao-Chung Wu, Taichung (TW)

(72) Inventors: Chao-Chung Wu, Taichung (TW); Yu-Lung Tsai, Taichung (TW)

(73) Assignee: Chao-Chung Wu, Taichung (TW)

( * ) Notice: Subject to any disclaimer, the term of this patent is extended or adjusted under 35 U.S.C. 154(b) by 196 days.

(21) Appl. No.: 15/135,927

(22) Filed: Apr. 22, 2016

(65) Prior Publication Data

US 2017/0304782 A1 Oct. 26, 2017

(51) Int. Cl.
*B01F 3/04* (2006.01)
*B01F 5/04* (2006.01)

(52) U.S. Cl.
CPC ..... *B01F 3/04248* (2013.01); *B01F 5/0425* (2013.01); *B01F 2003/04276* (2013.01); *B01F 2003/04319* (2013.01)

(58) Field of Classification Search
CPC .. B01F 3/04248; B01F 5/0415; B01F 5/0425; B01F 2003/04276; B01F 2003/04319
USPC ..... 261/79.2
See application file for complete search history.

(56) References Cited

U.S. PATENT DOCUMENTS 847,552 A * 3/1907 Carlson ..... F28F 25/082 222/394
3,567,116 A * 3/1971 Lindlof ..... B01F 5/0415 239/14.2
3,605,388 A * 9/1971 Zuiderweg et al. ..... B01D 3/26 261/114.1
3,953,002 A * 4/1976 England, Jr. ..... B01F 3/10 261/76
5,938,982 A * 8/1999 Sugiura ..... B01F 3/04503 261/75
6,027,241 A * 2/2000 King ..... B01F 3/0873 138/38
7,510,172 B2 * 3/2009 Kojima ..... B01D 53/18 261/113
7,624,969 B2 * 12/2009 Schletz ..... A01K 63/042 261/36.1
7,797,937 B2 * 9/2010 Endicott ..... F02B 29/0468 123/306
8,826,649 B2 * 9/2014 Li ..... F01N 3/2892 138/37

(Continued)

FOREIGN PATENT DOCUMENTS

TW M424358 U 3/2012

*Primary Examiner* — Charles Bushey
(74) *Attorney, Agent, or Firm* — Muncy, Geissler, Olds & Lowe, P.C.

(57) ABSTRACT

A fine bubble generating device is provided, including: a main body, having an inlet, an outlet and a venturi tube mechanism located between the inlet and the outlet, the venturi tube mechanism having a neck portion communicating with outside; a bubble fining mechanism, having at least one passage which is smaller than the inlet in cross-sectional area, the at least one passage communicating with and between the venturi tube mechanism and the outlet. The bubble fining mechanism includes a first vortex member having at least one first slant hole and a second vortex member having at least one second slant hole. The at least one first slant hole and the at least one second slant hole are inclined toward opposite directions, and the first vortex member and the second vortex member is disposed between the venturi tube mechanism and the outlet.

11 Claims, 7 Drawing Sheets

(56) References Cited

U.S. PATENT DOCUMENTS

2017/0252714 A1* 9/2017 Bennett ..... A01G 25/06

* cited by examiner

FINE BUBBLE GENERATING DEVICE

BACKGROUND OF THE INVENTION

Field of the Invention

The present invention relates to a bubbling device, and more particularly to a fine bubble generating device.

Description of the Prior Art

A common bubbling device as disclosed in TWM424358 can make a water flow be delicate and contain bubbles.

However, when this type of bubbling device is in use, air and water is mixed directly in the bubbling device without any mechanism which can fully mix air and water and fine bubbles. Therefore, air and water are not mixed evenly, and bubbles are in different sizes, so the water flow cannot maintain the state which is full of smooth and delicate bubbles.

The present invention has arisen to mitigate and/or obviate the afore-described disadvantages.

SUMMARY OF THE INVENTION

The major object of the present invention is to provide a fine bubble generating device, which can provide a water flow which is full of fine and delicate bubbles.

To achieve the above and other objects, a fine bubble generating device is provided, including: a main body, having an inlet, an outlet and a venturi tube mechanism located between the inlet and the outlet, the venturi tube mechanism having a neck portion communicating with outside; a bubble fining mechanism, having at least one passage which is smaller than the inlet in cross-sectional area, the at least one passage communicating with and between the venturi tube mechanism and the outlet, the bubble fining mechanism including a first vortex member and a second vortex member, the first vortex member including at least one first slant hole, the second vortex member including at least one second slant hole, the at least one first slant hole and the at least one second slant hole being inclined toward opposite directions, the first vortex member and the second vortex member being disposed between the venturi tube mechanism and the outlet.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
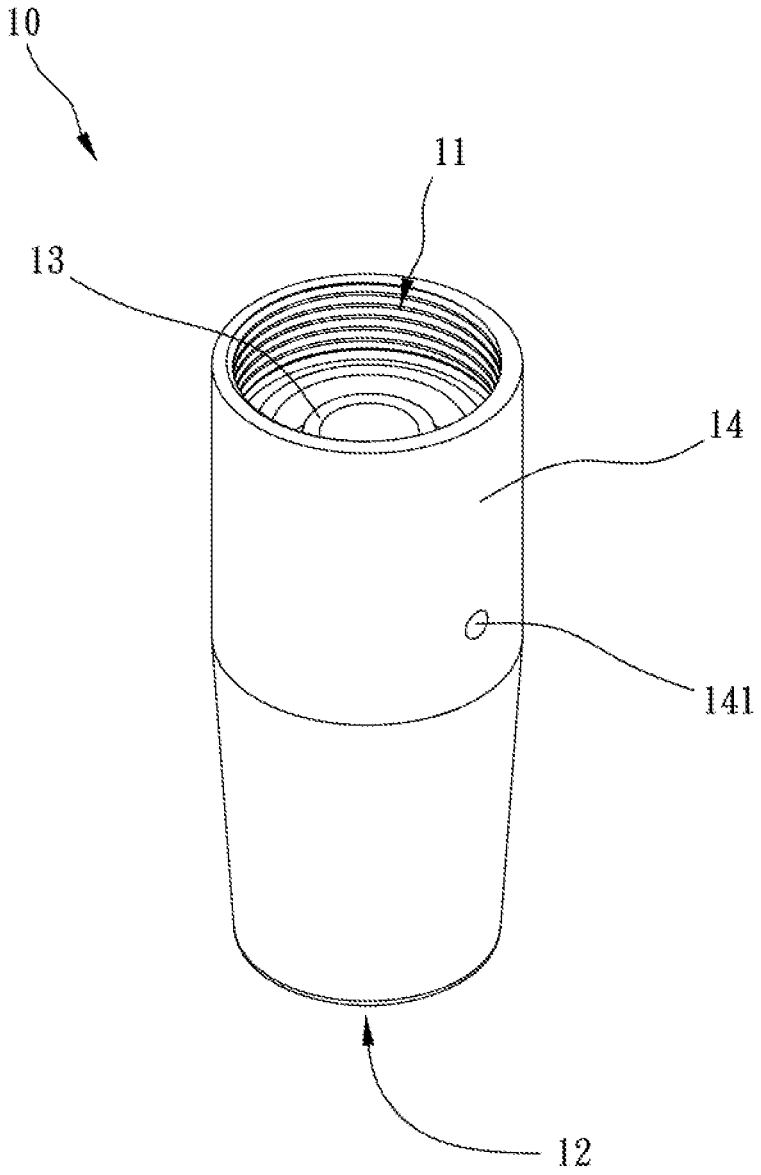
FIG. 1 is a perspective view of a preferred embodiment of the present invention.
Figure 2:
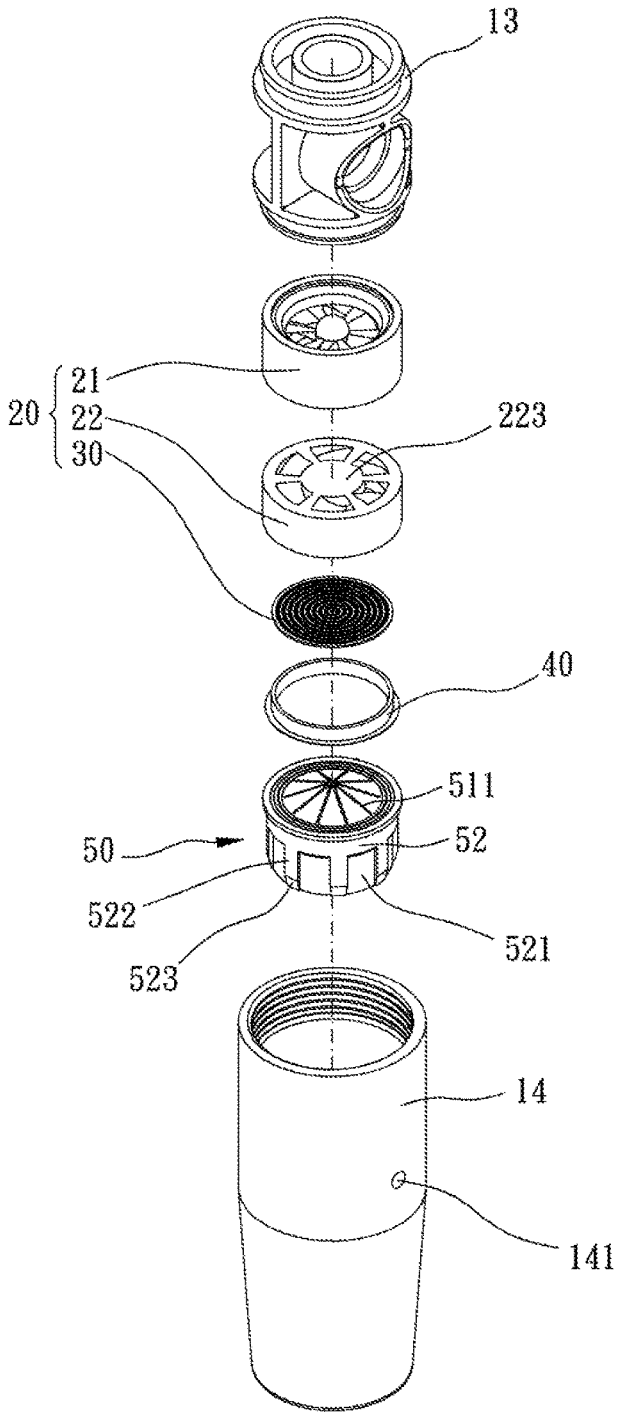
FIG. 2 is a breakdown view of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 8 for a preferred embodiment of the present invention. A fine bubble generating device 1 includes a main body 1 and a bubble fining mechanism 20.

The main body 10 has an inlet 11, an outlet 12 and a venturi tube mechanism 13 located between the inlet 11 and the outlet 12, the venturi tube mechanism 13 has a neck portion 131 communicating with outside, the inlet 11 is for a water flow to enter therethrough, the neck portion 131 is for inhaling air to be mixed with the water flow, and the outlet 12 is for the water flow to flow out from the main body 10. The bubble fining mechanism 20 has at least one passage which is smaller than the inlet 11 in cross-sectional area, and the at least one passage communicates with and between the venturi tube mechanism 13 and the outlet 12.

In this embodiment, the bubble fining mechanism 20 communicates with and between the venturi tube mechanism 13 and the outlet 12. The bubble fining mechanism 20 includes at least one of a first vortex member 21, a second vortex member 22 and a orifice board 30, the first vortex member 21 includes at least one first slant hole 211, the second vortex member 22 includes at least one second slant hole 221, the at least one first slant hole 211 and the at least one second slant hole 221 are inclined toward opposite directions, the orifice board 30 has a plurality of jetting holes 31, each said jetting hole 31 is tapered toward the outlet 12, the at least one of the first vortex member 21, the second vortex member 22 and the orifice board 30 is disposed between the venturi tube mechanism 13 and the outlet 12, and the at least one first slant hole 211 and the at least one second slant hole 221 are for producing reverse vortexes and enhancing a mixing effect of water and air. After the water flow goes out from the venturi tube mechanism 13, a flowing speed of water increases, and the water flow which contains air impacts the first vortex member 21 so that the water flow is broken, and air and water in the water flow are mixed. When the water flow passes through the first slant hole 211 and goes out from the first vortex member 21, the water flow swirls toward a direction and impacts the second vortex member 22, bubbles are fined, the water flow is broken again, and air and water in the water flow are mixed more evenly. After the water passes through the second slant hole 221 and goes out from the second vortex member 22, the water flow swirls toward another direction, the bubbles are further fined, and air and water are further mixed.

Figure 3:
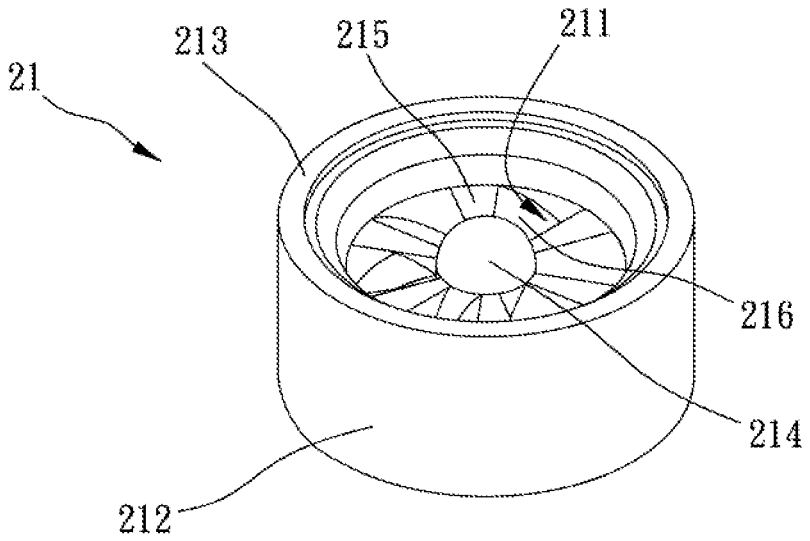
FIGS. 3 and 4 are drawings showing a first vortex member of the preferred embodiment of the present invention.

In this embodiment, the main body 10 further includes a barrel member 14, the venturi tube mechanism 13 is received in the barrel member 14, the barrel member 14 has an air-inlet hole 141 communicating with the neck portion 131, and the air-inlet hole 141 is for air to enter therethrough or for being connected to a tube and importing a specific gas (such as ozone). However, the barrel member 14 may not have the air-inlet hole 141, and the gas may be added from the inlet 11 directly. The first vortex member 21 includes a first barrel body 212, a first central portion 214 located in the first barrel body 212 and a first connecting portion 215 connected with the first barrel member 212 and the first central portion 214, and the first connecting portion 215, the first barrel body 212 and the first central portion 214 define the at least one first slant hole 211. An end of the first barrel body 212 near the inlet 11 has an annular guiding face 213 slanting inwardly (as shown in FIG. 3), the venturi tube mechanism 13 abuts against the annular guiding face 213, and the annular guiding face 213 is nearer to the inlet 11 than the first connecting portion 215 is so that a space above the first connecting portion 215 is kept for air and water in the water flow to be mixed. The first central portion 214 is semicircular and protrudes toward the venturi tube mechanism 13, after the water flow goes out from the venturi tube mechanism 13 and impacts the first central portion 214, the first central portion 214 guides the water flow which is broken toward the at least one first slant hole 211. The first connecting portion 215 includes a plurality of first blades 216, each of the plurality of first blades 216 is circumferentially around the first central portion 214 and slantly connected with the first barrel body 212 and the first central portion 214, and between every neighboring two of the first blades 216 exists one said first slant hole 211. The first connecting portion 215 is provided for supporting the first central portion 214, the first blades 216 make the water flow change a flowing direction and flow through the first slant hole 211 and out of the first vortex member 21, and the water flow can impact the first connecting portion 215 and the first blade 216 so that the water flow can be broken.

Figure 5:
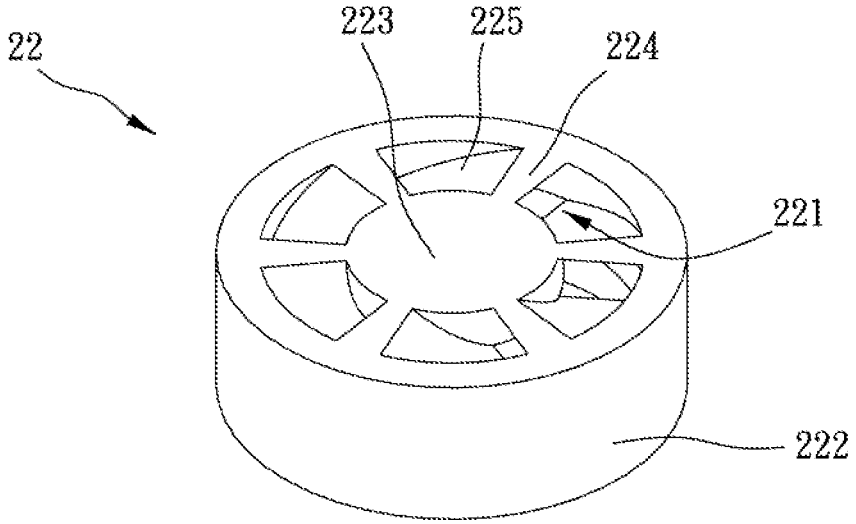
FIG. 5 is a drawing showing a second vortex member of the preferred embodiment of the present invention.
Figure 6:
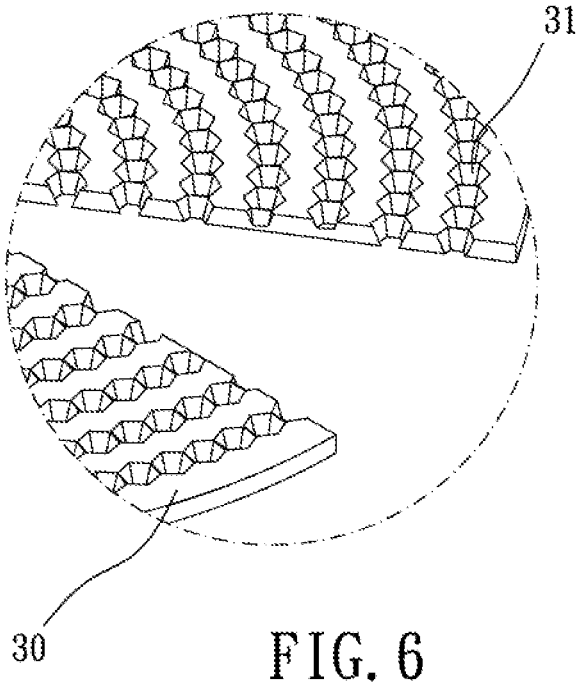
FIG. 6 is a partially-enlarged view of an orifice board of the preferred embodiment of the present invention.
Figure 7:
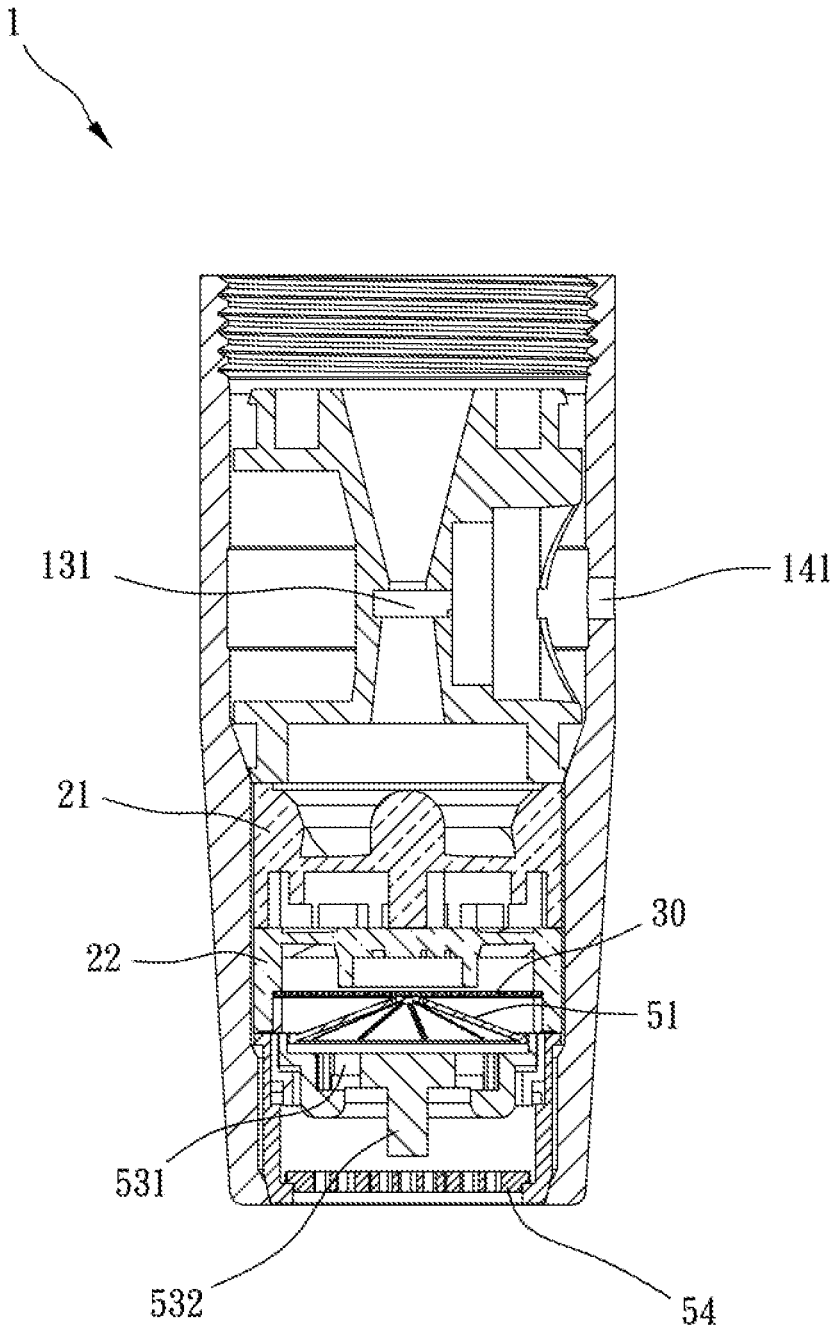
FIG. 7 is a cross-sectional view of the preferred embodiment of the present invention.
Figure 8:
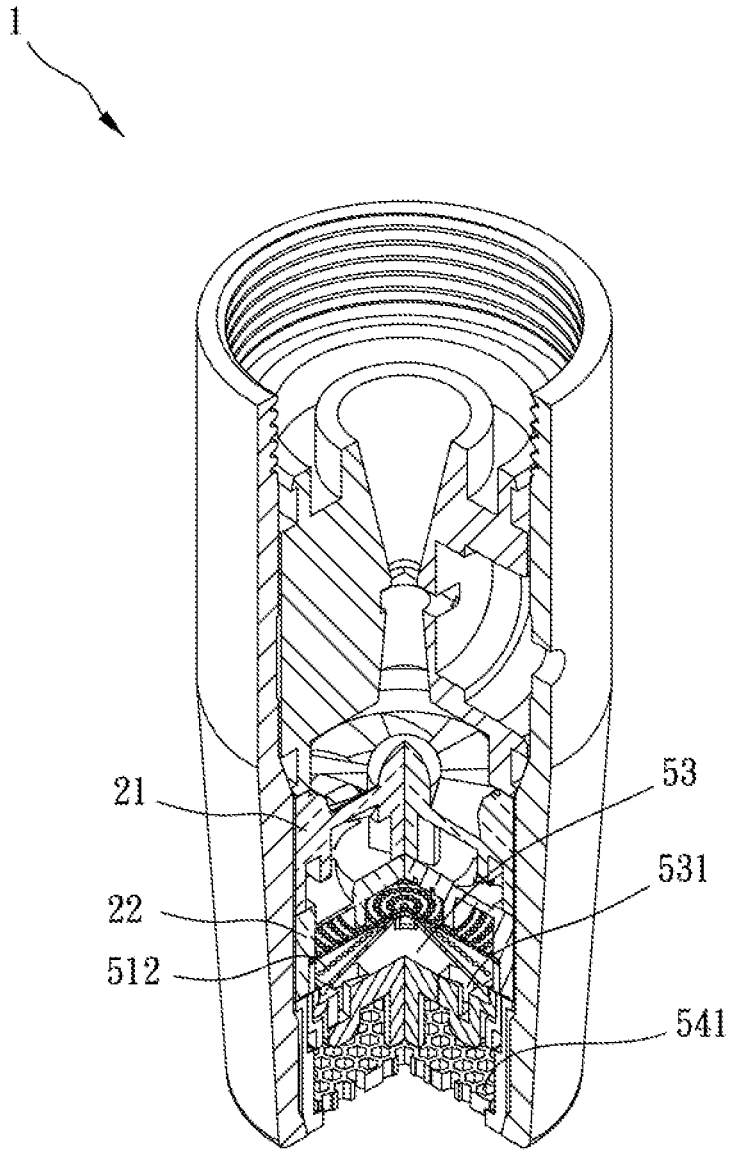
FIG. 8 is a perspective cross-sectional view of the preferred embodiment of the present invention.

In this embodiment, the second vortex member 22 includes a second barrel body 222, a second central portion 223 located in the second barrel body 222 and a second connecting portion 224 connected with the second barrel body 222 and the second central portion 223, and the second connecting portion 224, the second barrel body 222 and the second central portion 223 define the at least one second slant hole 221. The second connecting portion 224 includes a plurality of second blades 225, each of the plurality of second blades 225 is circumferentially around the second central portion 223 and slantly connected with the second barrel body 222 and the second central portion 223, and between every neighboring two of the second blades 225 exists one said second slant hole 221 (as shown in FIG. 5). A wall of the second barrel body 222 extends over the second central portion 223 and nearer to the outlet 12, and a space below the second central portion 223 is kept for the water flow which is broken to be mixed evenly. The second barrel body 222 abuts against the first barrel body 212, the second connecting portion 224 supports the second central portion 223, an inclination direction of the second blade 225 and an inclination direction of the first blade 216 are different so that after the water flow flows out from the first slant hole 211, the water flow impacts the second blade 225 in a direction perpendicular to the second blade 225. After the water flow impacts the second blade 225, the water flow is broken completely, and air and water in the water flow are mixed evenly and completely. When the water flow impacts the second vortex member 22, the water flow is further broken by the second connecting portion 224 and the second central portion 223.

Figure 4:
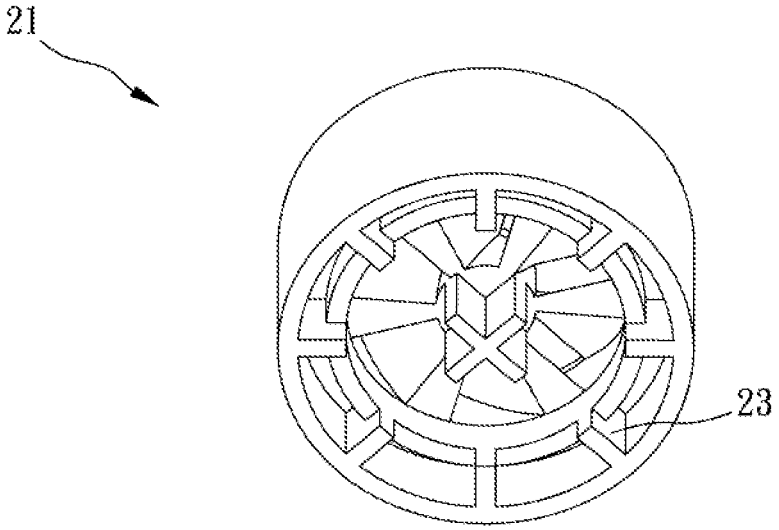

Preferably, the first vortex member may further include a plurality of blocking blocks 23 (as shown in FIG. 4) for the water flow to impact thereon and for breaking the water flow so that air and water in the water flow can be mixed evenly (the second vortex member may further include a plurality of blocking blocks).

In other embodiments, an air-inlet hole of a venturi tube mechanism may be connected to a tube for importing other liquids. A barrel member which is provided with the venturi tube mechanism may further have two air-inlet holes, and the two air-inlet holes are respectively for importing other liquids and gases. A central portion of a bubble fining mechanism may be a protrusion in other shapes, for example, triangle or any shape which can make the water flow broken after the water flow impacts thereon. A first vortex member, a second vortex member and an orifice board of a bubble fining mechanism may be assembled alone or selectively cooperate with one another, for example, the bubble fining mechanism of a fine bubble generating device may have only one first vortex member, or the bubble fining mechanism of a fine bubble generating device may have only one second vortex member and an orifice board.

In this embodiment, the fine bubble generating device 1 further includes a bubbler 50 which communicates with and between an interior of the bubble fining mechanism 20 and the outlet 12 and a spacing ring 40 abutting against between the bubbler 50 and the orifice board 30. The bubbler 50 includes a tapered board 51 facing the second barrel body 222, the tapered board 51 has a plurality of hole rows 511 radiantly arranged thereon, each said hole row 511 includes a plurality of through holes 512, and the through hole 512 is greater than the jetting hole 31 in dimension. The bubbler 50 further includes an annular shell 52, a flow-guiding core 53 received in the annular shell 52 and an outlet orifice board 54, two opposite sides of the flow-guiding core 53 respectively has an annular recess 531, the outlet orifice board 54 and the tapered board 51 are respectively arranged on two opposite ends of the annular shell 52, the outlet orifice board 54 has a plurality of flowing holes 541, each said flowing hole 541 is greater than the through hole 512 and communicates with the outlet, and the flowing holes 541 is for the water flow to flow out from the fine bubble generating device 1. A number of the through holes 512 is smaller than a number of the jetting holes 31, and a water flow jetted from each said jetting hole 31 has a greater hydraulic pressure, so the bubbles are fined, and air and water are mixed more completely. An outer surface of the annular shell 52 has a groove 521 which is circumferentially arranged in interval, between every neighboring two of the grooves 521 exists a protrusive bar 522, an end of each said protrusive bar 522 near the outlet 12 has a chamfer 523 which is abuttable against an inner wall of the barrel member 14 so that the bubbler 50 is fixed in the barrel member 14, and the grooves 521 is non-contacted with the inner wall of the barrel member 14 so that the bubbler 50 is not stuck in the barrel member 14. The annular recess 531 is for being impacted by a water flow having a greater hydraulic pressure flowing out from each said through hole 512 to make the bubbles in the water flow more delicate, and the water flow flows out from a side of the annular recess 531. The flow-guiding core 53 protrudes toward a center of the outlet orifice board 54 to form an axial column 532, and the axial column 532 is for restricting the outlet orifice board 54 within a range so that the outlet orifice board 54 will not shake or flip during a process of water flowing out. The spacing ring 40 supports the orifice board 30, and when the hydraulic pressure is greater, the center of the orifice board 30 is bent downward slightly due to the hydraulic pressure, and a center protruding on the tapered board 51 can support the orifice board 30 properly.

Figure 9:
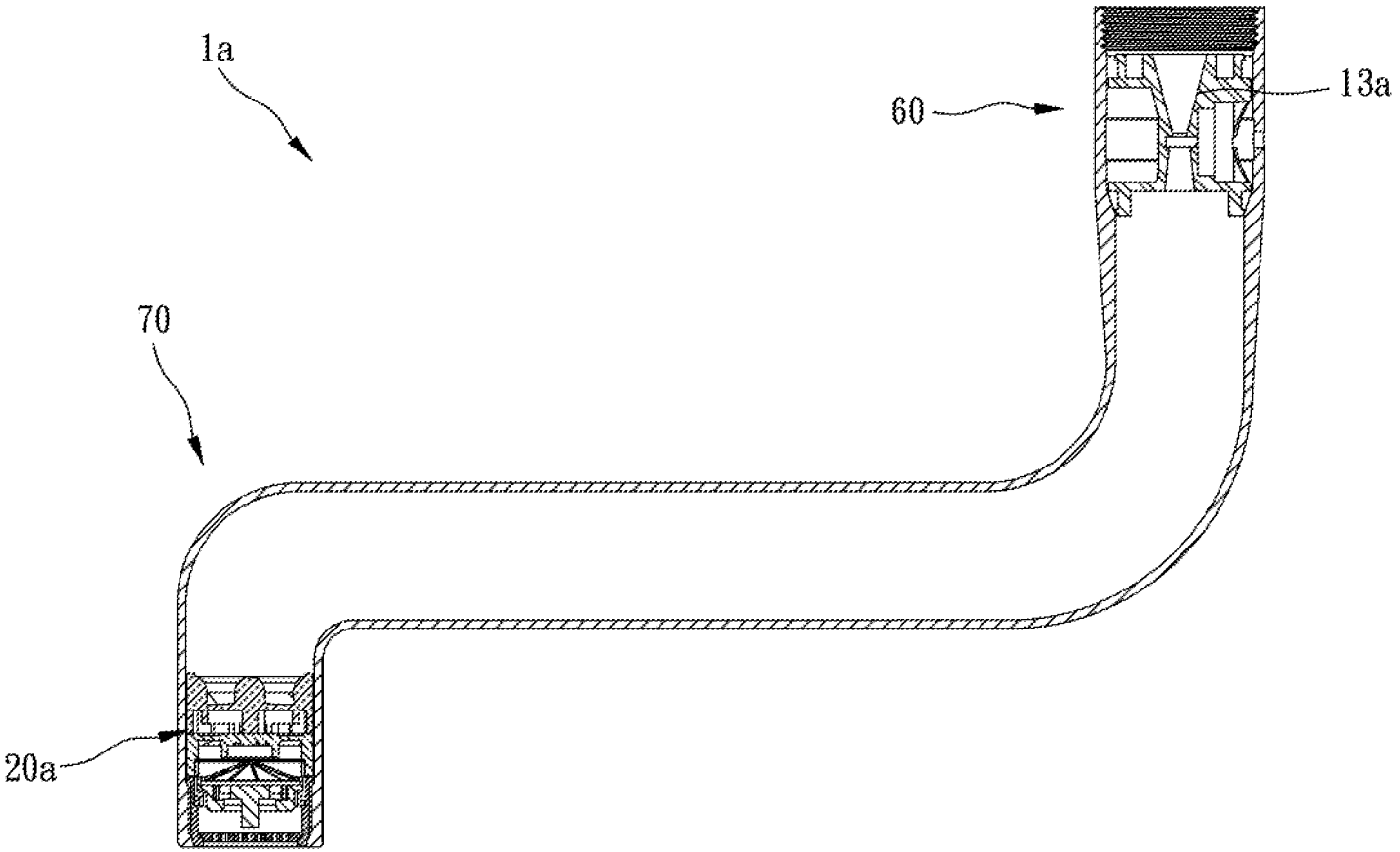
FIG. 9 is a cross-sectional view of another preferred embodiment of the present invention.

Please refer to FIG. 9 for another embodiment. A main body of a fine bubble generating device la includes an assembling section 60 and an extension section 70 extending from the assembling section 60, a venturi tube mechanism 13a is arranged in the assembling section 60, and a bubble fining mechanism 20a is arranged in the extension section 70 and near a distal end of the extension section 70 to prevent the bubbles in the water flow from disappearing too soon. The extension section 70 is longer than the assembling section 60, and the bubble fining mechanism 20a can be selectively assembled with a first vortex member, a second vortex member or an orifice board.

Given the above, the first vortex member and the second vortex member can make the bubbles fine and produce the reverse vortexes to increase the mixing effect of water and air. Therefore, air and water in the water flow can be mixed evenly and completely, and the water flow becomes smooth and delicate.

While we have shown and described various embodiments in accordance with the present invention, it should be clear to those skilled in the art that further embodiments may be made without departing from the scope of the present invention.

What is claimed is:

1. A fine bubble generating device, including:

a main body, having an inlet, an outlet and a venturi tube mechanism located between the inlet and the outlet, the venturi tube mechanism having a neck portion communicating with outside; and a bubble fining mechanism, having at least one passage which is smaller than the inlet in cross-sectional area, the at least one passage communicating with and between the venturi tube mechanism and the outlet, the bubble fining mechanism including a first vortex member and a second vortex member, the first vortex member including at least one first slant hole, the second vortex member including at least one second slant hole, the at least one first slant hole and the at least one second slant hole being inclined toward opposite directions, the first vortex member and the second vortex member being disposed between the venturi tube mechanism and the outlet, wherein the bubble fining mechanism further includes an orifice board, the orifice board has a plurality of jetting holes, and the second vortex member is disposed between the first vortex member and the orifice board.

2. The fine bubble generating device of claim 1, wherein the main body includes a barrel member, the venturi tube mechanism is received in the barrel member, and the barrel member has an air-inlet hole communicating with the neck portion.

3. The fine bubble generating device of claim 1, wherein the first vortex member includes a first barrel body, a first central portion located in the first barrel body and a first connecting portion connected with the first barrel member and the first central portion, and the first connecting portion, the first barrel body and the first central portion define the at least one first slant hole.

4. The fine bubble generating device of claim 3, wherein the first connecting portion includes a plurality of first blades, each of the plurality of first blades is circumferentially around the first central portion and slantly connected with the first barrel body and the first central portion, and between every neighboring two of the first blades exists one said first slant hole.

5. The fine bubble generating device of claim 3, wherein an end of the first barrel body near the inlet has an annular guiding face slanting inwardly, and the venturi tube mechanism abuts against the annular guiding face.

6. The fine bubble generating device of claim 1, wherein the second vortex member includes a second barrel body, a second central portion located in the second barrel body and a second connecting portion connected with the second barrel body and the second central portion, and the second connecting portion, the second barrel body and the second central portion define the at least one second slant hole.

7. The fine bubble generating device of claim 6 wherein the second connecting portion includes a plurality of second blades, each of the plurality of second blades is circumferentially around the second central portion and slantly connected with the second barrel body and the second central portion, and between every neighboring two of the second blades exists one said second slant hole.

8. The fine bubble generating device of claim 1, wherein the jetting hole is tapered toward the outlet.

9. The fine bubble generating device of claim 1, wherein the main body includes an assembling section and an extension section extending from the assembling section, the venturi tube mechanism is arranged in the assembling section, the bubble fining mechanism is arranged in the extension section and near a distal end of the extension section, and the extension section is longer than the assembling section.

10. The fine bubble generating device of claim 1, further including a bubbler which communicates with and between an interior of the bubble fining mechanism and the outlet, and further including a spacing ring abutting against between the bubbler and the orifice board.

11. The fine bubble generating device of claim 4, wherein the main body further includes a barrel member, the venturi tube mechanism is received in the barrel member, the barrel member has an air-inlet hole communicating with the neck portion;

an end of the first barrel body near the inlet has an annular guiding face slanting inwardly, the venturi tube mechanism abuts against the annular guiding face, the annular guiding face is nearer to the inlet than the first connecting portion is; the second vortex member includes a second barrel body, a second central portion located in the second barrel body and a second connecting portion connected with the second barrel body and the second central portion, the second connecting portion, the second barrel body and the second central portion define the at least one second slant hole, the second connecting portion includes a plurality of second blades, each of the plurality of second blades is circumferentially around the second central portion and slantly connected with the second barrel body and the second central portion, between every neighboring two of the second blades exists one said second slant hole; the jetting hole is tapered toward the outlet; and the fine bubble generating device further includes a bubbler which communicates with and between an interior of the bubble fining mechanism and the outlet and further includes a spacing ring abutting against between the bubbler and the orifice board.

* * * * *